United States Patent [19]

Koyama

[11] 3,951,176

[45] Apr. 20, 1976

[54] HOOK CONNECTING APPARATUS IN A CHAIN DISC-TYPE DOBBY MACHINE

[75] Inventor: Akira Koyama, Nagoya, Japan

[73] Assignee: Yamada Dobby Co., Ltd., Nagoya, Japan

[22] Filed: Dec. 31, 1974

[21] Appl. No.: 537,740

[30] Foreign Application Priority Data

Jan. 9, 1974 Japan ..... 49-6241

[52] U.S. Cl. ..... 139/68; 139/71; 139/331

[51] Int. Cl.[2] ..... D03D 1/06

[58] Field of Search ..... 139/66 R, 66 A, 67–74, 139/331

[56] References Cited

UNITED STATES PATENTS

| | | | |
|---|---|---|---|
| 3,285,291 | 11/1966 | Favre | 139/68 |
| 3,381,719 | 5/1968 | Favre | 139/68 |
| 3,441,060 | 4/1969 | Schwarz | 139/68 |

FOREIGN PATENTS OR APPLICATIONS

| | | | |
|---|---|---|---|
| 370,025 | 6/1963 | Switzerland | 139/72 |
| 442,926 | 12/1948 | Italy | 139/71 |
| 544,802 | 4/1942 | United Kingdom | 139/71 |

*Primary Examiner*—James Kee Chi

*Attorney, Agent, or Firm*—Frank J. Jordan

[57] ABSTRACT

In a chain disc-type compound dobby machine, flexible instruction receiving members are integrally fixed to supporting hooks for decreasing the weight and the moment of inertia of the moving parts so that the connecting and detaching action of the hooks may be securely and easily performed. Moreover the number of parts is reduced and the structure becomes simple while at the same time effecting a stable high speed operation of the dobby machine.

9 Claims, 6 Drawing Figures

HOOK CONNECTING APPARATUS IN A CHAIN DISC-TYPE DOBBY MACHINE

BACKGROUND OF THE INVENTION

1. Field of the Invention

The present invention relates to a compound dobby machine used in a loom for weaving a dobby fabric, and particularly to an improvement of a hook connecting member in a chain disctype compound dobby machine.

2. Description of the Prior Art

A conventional chain disc-type compound dobby machine is shown in FIG. 6 as comprising upper and lower rocking hooks $\mathbf{51}_a$ and $\mathbf{51}_b$ as a fabric weave selecting mechanism supported on a machine base of a dobby machine, an upper hook $\mathbf{52}_a$ and a lower hook $\mathbf{52}_b$ connecting respectively with the upper and lower rocking hooks $\mathbf{51}_a$ and $\mathbf{51}_b$, a chain 53 connecting the upper and lower hooks $\mathbf{52}_a$ and $\mathbf{52}_b$, a jack lever 54 supported at the bottom thereof, and a rotating plate 55 pivoted nearly at the center of the jack lever 54. The chain 53 engages the rotating plate 55 whereby the upper hook $\mathbf{52}_a$ and lower hook $\mathbf{52}_b$ are moved linearly respectively by means of an upper knife $\mathbf{56}_a$ and a lower knife $\mathbf{56}_b$ in linear reciprocating motion so as to permit the jack lever 54 to be movable in a forward and backward rocking motion.

In recent years, the operating speed of dobby machines have been remarkably increasing in accordance with the high speed operation of looms. However, in a conventional compound dobby machine as shown in FIG. 6, parts which act according to instruction of the weave selecting mechanism 57, for example, the fish lever $\mathbf{58}_a$ and the rocking hook $\mathbf{51}_a$, are mounted respectively on separate shafts $\mathbf{59}_a$ and $\mathbf{60}_a$, or together on one shaft (not shown). Such fish lever $\mathbf{58}_a$ and rocking hook $\mathbf{51}_a$ are held in the connecting position by means of the springs $\mathbf{62}_a$, $\mathbf{63}_a$ and transmit the action for the fish lever $\mathbf{58}_a$ to the rocking hook $\mathbf{51}_a$ according to instruction from the weave selecting mechanism 57 to displace the rocking hook $\mathbf{51}_a$ to which the hook $\mathbf{52}_a$ is connected in reciprocating motion by means of the knife 56. As above described, the fish lever $\mathbf{58}_a$ and the rocking hook $\mathbf{51}_a$, both moved by the weave selecting mechanism 57, are separate structures, therefore the heavy weight decreases the efficiency for transmitting the motion according to instructions, particularly in high speed operation, and the moment of inertia increases tending to hinder the rotating speed.

SUMMARY OF THE INVENTION

The present invention provides a hook connecting apparatus in a chain disc-type compound dobby machine, wherein a fish lever is made up of an instruction receiving member of light weight having elasticity and flexibility, one end of which instruction receiving member is fixed to a supporting hook oscillatably mounted on a supporting shaft so as to thereby constitute an integral structure with the supporting hook. The hooking portions of the supporting hooks are connected respectively with upper and lower reciprocally mounted hooks and are energized or biased by the elastic bending of the instruction receiving member for elastic or bias connection with the hooks to thereby provide for high speed operation of the dobby machine.

OBJECTS OF THE INVENTION

An object of the present invention is to overcome the aforementioned disadvantages of known prior art arrangements and to decrease the moment of inertia of moving parts according to weave selecting instruction in a chain disc-type compound dobby machine by changing a fish lever into an instruction receiving member of light weight having elasticity and flexibility.

Another object of the present invention is to securely and easily effect the connecting and detaching action of the hooking portion of the supporting hook with the hook in linear motion by fixing an instruction receiving member to a supporting hook as an integral structure and utilizing the elastic bending properties of the elastic receiving member.

A further object of the present invention is to decrease the number of parts of the supporting hook and to simplify the structure.

A still further object of the present invention is to increase the rotating speed of a dobby machine by decreasing the moment of inertia of the moving parts, by making secure the connecting and detaching action of the supporting hook by means of elastic bending of the instruction receiving member, and by simplifying the structure.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

DESCRIPTION OF THE PREFERRED EMBODIMENTS

Figure 1:
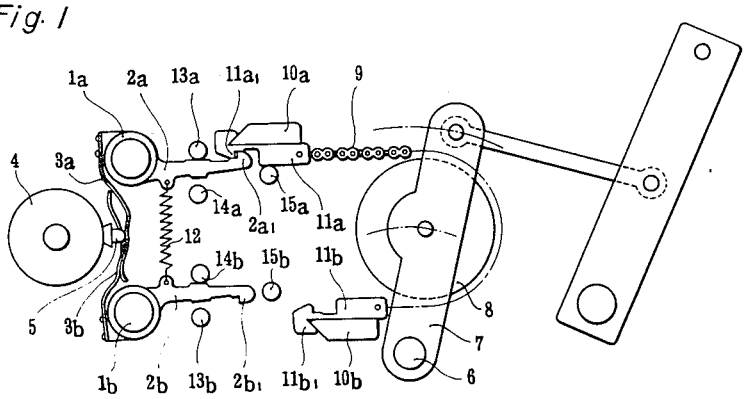
FIG. 1 is a view illustrating a hook connecting apparatus according to one embodiment of the present invention.

Referring to the drawings, there is shown in FIG. 1 an upper supporting shaft $1_a$ mounted on a machine base. This shaft $1_a$ is oscillatable and carries an upper supporting hook $2_a$ on the tip of which there is provided a hooking portion $2_a$ . One end of an upper instruction receiving member $3_a$ is fixed to the end surface of the upper supporting hook $2_a$ on the end thereby adjacent to the upper supporting shaft $1_a$. The instruction receiving member $3_a$ is disposed in a direction approximately perpendicular to the upper supporting hook $2_a$.

The upper instruction receiving member $3_a$ is flexible, for example it may be in the form of a leaf spring, and is provided with a sliding surface $3_{a'}$ which may be flexibly or elastically bent by being activated or pushed by a peg 5 of a card apparatus 4 so that the upper supporting hook $2_a$ is rocked by means of the engagement or pushing of the sliding surface $3_{a'}$ by the peg 5 for transmitting instructions.

Near the center of an oscillatable jack lever 7, the lower end of which is mounted on a shaft 6 which is carried on the machine base, there is arranged a rotating disc 8 on which is mounted a chain 9. By means of this chain drive of a so-called chain disc type drive, upper and lower hooks $11_a$, $11_b$ are moved in reciprocating motion by upper and lower knives $10_a$, $10_b$ moving linearly at both ends of the chain 9. A hooking portion $11_{a'}$ of the upper hook $11_a$ is adapted to be connected to the hooking portion $2_{a'}$ of the upper supporting hook $2_a$ as will be further described.

In completely symmetric position relative to upper supporting hook $2_a$, upper instruction receiving member $3_a$, upper knife $10_a$ and upper hook $11_a$, there are provided a lower supporting hook $2_b$, lower instruction receiving member $3_b$, lower knife $10_b$ and lower hook $11_b$. In addition the upper supporting hook $2_a$ and lower supporting hook $2_b$ are pivotally biased toward each other by means of a spring 12.

Outer stops $13_a$, $13_b$ are provided respectively for the upper and lower supporting hooks $2_a$, $2_b$ and inner stops $14_a$, $14_b$ for these same hooks. Hook stops $15_a$, $15_b$ are also provided respectively on the inner side of the upper and lower hooks $11_a$, $11_b$.

Operation of the above described apparatus will now be set forth. For easy understanding, only the connection of the upper supporting hook $2_a$ with the upper hook $11_a$ will be described although it will be understood that the connection of the lower supporting hook $3_a$ with the lower hook $11_b$ occurs similarly.

Figure 2:
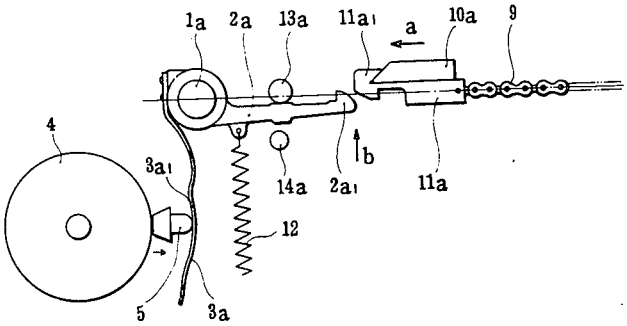
FIG. 2 is a partial view of the hook connecting apparatus in FIG. 1 showing the position of the parts just before the supporting hook is about to connect with the hook in linear motion.

Referring to FIG. 2, when the upper hook $11_a$ moves in the direction of arrow *a* by means of the linear reciprocating motion of the upper knife $10_a$, before arrival of the upper hook $11_a$ to its connecting position, the upper instruction receiving member $3_a$ is rotated by the peg 5 of the card apparatus 4 to overcome the bias of spring 12. Accordingly, the upper supporting hook $2_a$ is rotated in the direction of arrow *b* until it contacts the outer stop $13_a$ where it awaits the arrival of the hooking portion $11_{a'}$ of upper hook $11_a$ in a position where the hooking portion $2_{a'}$ can connect with the hooking portion $11_{a'}$ of the upper hook $11_a$.

Figure 3:
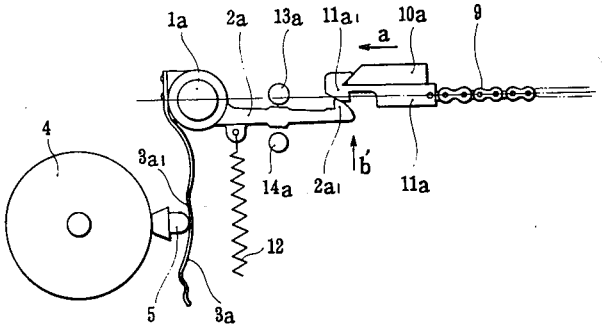
FIG. 3 is a view illustrating the operating position wherein, in the forward motion of the hook, the supporting hook is moved against the instruction receiving member and the hooking portion of the supporting hook is rotated against the bias of the instruction receiving member.

Referring to FIG. 3, when the upper hook $11_a$ moves further to the left, the hooking portion $11_{a'}$ of the upper hook $11_a$ will move linearly and therefore will push the hooking portion $2_{a'}$ of the upper supporting hook $2_a$ downwardly. In this state, since the upper instruction receiving member $3_a$ is engaged or pushed by the peg 5, and since the hooking portion $2_{a'}$ is being pushed down by the hooking portion $11_{a'}$ of the upper hook $11_a$, the upper instruction receiving member $3_a$ will flex and strengthen its elasticity or biasing force so as to energize the spring action force in the direction of arrow *b*, that is in a direction toward the hooking portion $2_{a''}$.

Figure 4:
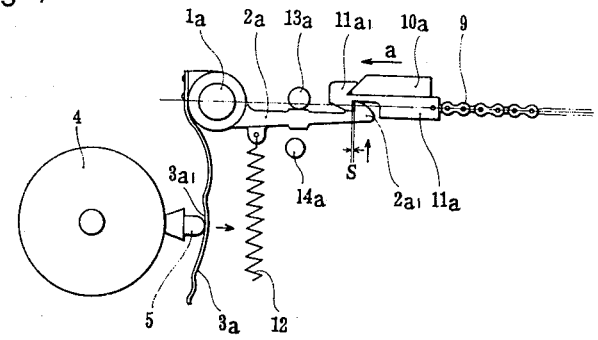
FIG. 4 is a view illustrating the operating condition wherein the hook passes over the hooking portion of the receiving hook sufficiently so as to provide a gap between the hooking portions.

Referring to FIG. 4, as the upper hook $11_a$ still continues to move to the left, the hooking portion $11_{a'}$ of the upper hook $11_a$ rides over the hooking portion $2_{a'}$ so that a gap S is provided between the hooking portion $11_{a'}$ and the hooking portion $2_{a''}$.

In this condition, the hooking portion $2_{a''}$, which was biased by the elastic bending of the upper instruction receiving member $3_a$, as previously described, is instantaneously pushed upwardly and the hooking portion $11_{a'}$ of the upper hook $11_a$ contacts or engages the hooking portion $2_{a'}$ of the upper supporting hook $11_a$ when the pushing of the upper hook $11_a$ by the upper knife $10_a$ is released.

In this latter condition, even if the card apparatus 4 is rotated and the peg 5 passes out of contact with the sliding surface $3_{a'}$ of the upper instruction receiving member $3_a$, the upper supporting hook $2_a$ is still held in connecting position.

Thus, even though there is no peg 5 contacting sliding surface $3_{a'}$ , and even though the spring 12 continues to exert a biasing force on upper hook $2_a$, since the biasing force applied by spring 12 is less than the force applied by the chain 9 or rope, the connection is not released.

Figure 5:
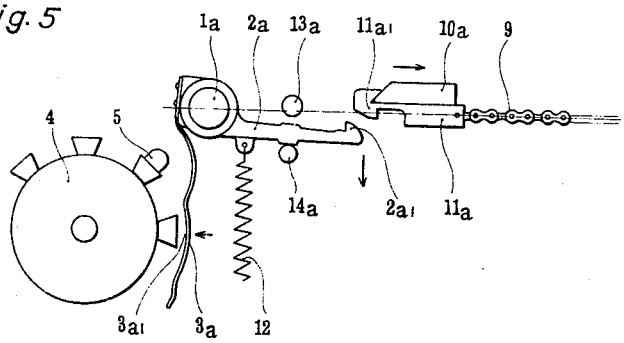
FIG. 5 is a view illustrating the operating condition wherein the connection between the hook and the supporting hook is released.

However, when the upper knife $10_a$ moves back and pushes the upper hook $11_a$ so that the gap S is again established between the hooking portion $11_{a'}$ of the upper hook $11_a$ and the hooking portion $2_{a'}$ of the upper supporting hook $2_a$, the upper supporting $2_a$ is rotated by the pulling or biasing force of the spring 12 and the connection is released as shown in FIG. 5. At the same time, as the upper supporting hook $2_a$ stops on the inner stop $14_a$, the upper supporting hook $2_a$ does not connect with the upper hook $11_a$ even when the upper hook $11_a$ is moved again.

Figure 6:
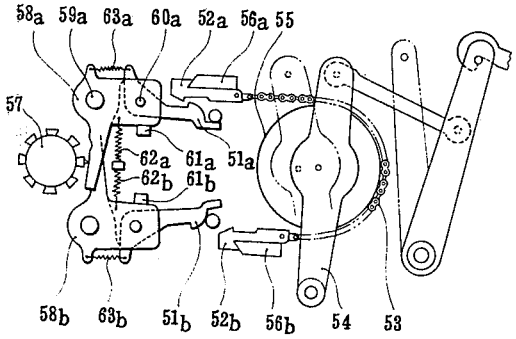
Fig. 6 PRIOR ART
FIG. 6 is a view illustrating an arrangement of a conventional hook connecting apparatus in a chain disc-type compound dobby machine.

As described above, in the present invention, parts corresponding to conventional fish levers $58_a$, $58_b$ as shown in FIG. 6 are replaced by the instruction receiving members $3_a$, $3_b$ which can be flexibly or elastically bent and which are fixed to the supporting hooks $2_a$, $2_b$ respectively so as to constitute an integral structure. Therefore, members moving according to the weave selecting instructions can remarkably be made light weight, the amount of inertia of the moving body is decreased, and further wear between the parts is decreased by means of the intergral construction. It will also be seen that connection and detaching of the hooks may be effected securely and easily and moreover, springs $63_a$, $63_b$ as shown in FIG. 6 are unnecessary, the number of necessary parts is reduced, and the construction becomes simple. Therefore, these advantages contribute to improve the rotating speed of a dobby machine and provide a superior operating effect.

It is thought that the invention and many of its attendant advantages will be understood from the foregoing description and that it will be apparent that various changes may be made in the form, construction, and arrangments of the parts without departing from the spirit and scope of the invention or sacrificing all of its material advantages. The form heretofore described being merely a preferred embodiment thereof.

What is claimed is:

1. A hook connecting apparatus of the chain disc-type as used in a compound dobby machine, comprising pivotally mounted supporting hooks, biasing means biasing said supporting hooks for pivotal movement in one rotational direction, reciprocally mounted hooks adapted to engage said supporting hooks, elongated flexible instruction receiving members each having one end portion secured to said supporting hook and an opposite end portion projecting from said supporting hook to thereby define a unitized pivotal structure having a flexible projection, and instruction means operable to engage said flexible projection of said flexible instruction receiving members to effect rotation of said supporting hooks in a direction opposite to said one rotational direction, said supporting hooks being biased in said opposite rotational direction by the engagement of said flexible instruction receiving members with said instruction means such that said flexible instruction receiving members are thereby operable to effect a biasing connection between said supporting hooks and said reciprocally mounted hooks.

2. A hook connecting apparatus according to claim 1 wherein said flexible instruction receiving member is a leaf spring.

3. A hook connecting apparatus according to claim 1 wherein said instruction means comprises a peg which slidably engages said flexible instruction receiving members to effect flexing and displacement of the latter and biasing of said supporting hooks in said one rotational direction.

4. A hook connecting apparatus according to claim 1 including stop means for limiting the extreme pivotal position of said supporting hooks.

5. A hook connecting apparatus according to claim 1 wherein said supporting hooks are arranged in opposed pairs, said biasing means comprising springs disposed between opposed pairs of supporting hooks and biasing the latter towards one another.

6. A hook connecting apparatus according to claim 5 including operable means for reciprocating said reciprocally mounted hooks, said operable means effecting engagement between said supporting hooks and said reciprocating hooks with an engagment force greater than the biasing force of said spring means.

7. A hook connecting apparatus according to claim 1 wherein said reciprocally mounted hooks have hook ends operable to engage said support hooks and effect rotation of said supporting hooks in opposition to the bias of said flexible instruction receiving member.

8. A hook connecting apparatus according to claim 1 wherein said reciprocally mounted hooks and said supporting hooks each have engageable transverse surfaces, said reciprocally mounted hooks being reciprocatory to an extreme inner position in which said engageable transverse surfaces are slightly spaced from one another.

9. A hook connecting apparatus according to claim 2 wherein said leaf spring has an arcuate surface adapted to be engaged by said instruction means.

* * * * *